US006244521B1

(12) United States Patent
Sesser

(10) Patent No.: US 6,244,521 B1
(45) Date of Patent: Jun. 12, 2001

(54) MICRO-STREAM ROTATOR WITH ADJUSTMENT OF THROW RADIUS AND FLOW RATE

(75) Inventor: George Sesser, Walla Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 0 days.

(21) Appl. No.: 09/433,299

(22) Filed: Nov. 3, 1999

(51) Int. Cl.[7] ..... B05B 3/04
(52) U.S. Cl. ..... 239/222.17
(58) Field of Search ..... 239/222.15, 222.17, 239/222.19, 230, 231, 262, 252, 97, 753, 754, 465, 476, 482, 483, 484

(56) References Cited

U.S. PATENT DOCUMENTS

| | | | | |
|---|---|---|---|---|
| Re. 32,386 | | 3/1987 | Hunter | 239/206 |
| Re. 33,823 | | 2/1992 | Nelson et al. | 239/222.17 |
| 3,131,867 | | 5/1964 | Miller et al. | 239/222.12 |
| 3,884,416 | * | 5/1975 | King | 239/230 |
| 3,940,066 | | 2/1976 | Hunter | 239/204 |
| 4,119,275 | | 10/1978 | Hunter | 239/204 |
| 4,154,404 | | 5/1979 | Clawson | 239/363 |
| 4,261,515 | * | 4/1981 | Rosenberg et al. | 239/222.17 |
| 4,579,285 | | 4/1986 | Hunter | 239/457 |
| 4,815,662 | | 3/1989 | Hunter | 239/222.17 |
| 4,842,201 | | 6/1989 | Hunter | 239/240 |
| 4,850,532 | * | 7/1989 | Mackanos | 239/204 |
| 4,867,379 | | 9/1989 | Hunter | 239/240 |
| 4,898,332 | | 2/1990 | Hunter et al. | 239/240 |
| 4,932,590 | | 6/1990 | Hunter | 239/222.17 |
| 4,944,456 | * | 7/1990 | Zakai | 239/222.19 |
| 4,967,961 | | 11/1990 | Hunter | 239/240 |
| 4,971,250 | | 11/1990 | Hunter | 239/222.17 |
| 4,986,474 | | 1/1991 | Schisler et al. | 239/205 |
| 5,031,840 | | 7/1991 | Grundy et al. | 239/456 |
| 5,058,806 | | 10/1991 | Rupar | 239/222.17 |
| 5,148,990 | | 9/1992 | Kah, Jr. | 239/222.17 |
| 5,226,602 | | 7/1993 | Cochran et al. | 239/363 |
| 5,288,022 | | 2/1994 | Sesser | 239/205 |
| 5,360,167 | | 11/1994 | Grundy et al. | 239/460 |
| 5,556,036 | | 9/1996 | Chase | 239/460 |
| 5,647,541 | * | 7/1997 | Nelson | 239/590.5 |
| 5,762,270 | | 6/1998 | Kearby et al. | 239/205 |
| 5,823,440 | | 10/1998 | Clark | 239/206 |
| 5,927,607 | | 7/1999 | Scott | 239/205 |

* cited by examiner

*Primary Examiner*—David A. Scherbel
*Assistant Examiner*—Jorge Bocanegra
(74) *Attorney, Agent, or Firm*—Nixon & Vanderhye P.C.

(57) ABSTRACT

A rotating stream sprinkler comprising a rotor plate supported on one end of a shaft for rotation, in an operative mode, relative to the shaft; a nozzle located along the shaft upstream of the rotor plate; a baffle fixed to an opposite end of the shaft; a core flow path component located along the shaft between the nozzle and the baffle; and a clutch device for enabling in an adjustment mode, rotation of the rotor plate with the shaft and the baffle relative to the core flow path component to thereby alter the flow of water through the core flow path component toward the nozzle.

12 Claims, 7 Drawing Sheets

MICRO-STREAM ROTATOR WITH ADJUSTMENT OF THROW RADIUS AND FLOW RATE

TECHNICAL FIELD

This invention relates to landscape and agricultural irrigation sprinklers and, specifically, to a rotating, viscously damped sprinkler which permits adjustment of the stream pattern, throw radius and flow rate.

BACKGROUND

Sprinklers utilizing a fixed nozzle to emit a stream onto the grooves of a viscously damped rotor plate are known in the art and examples of such constructions may be found in commonly owned U.S. Pat. Nos. 5,288,022 and 5,058,806. Sprinklers of this type may be incorporated into pop-up type arrangements or they may be mounted on, for example, fixed riser pipes. In either case, it is possible to employ adjustable or interchangeable nozzles having orifices which emit a 360° stream, a 180° stream, a 90° stream, etc. so as to produce a desired sprinkling pattern, to be determined primarily by the location of the sprinkler. There is also a need, however, to be able to adjust the throw radius and flow rate of the sprinkler without varying the water pressure.

SUMMARY OF THE INVENTION

This invention provides an internal rotary valve in the base of the sprinkler mechanism which can be actuated by pressing down on the sprinkler rotor plate to thereby engage a valve drive mechanism and rotating the rotor plate to open or close the internal valve between maximum open or closed positions, or any position therebetween.

As is well known in the art, the rotor plate itself is provided with specially configured grooves which cause the rotor plate to rotate when a stream emitted from the nozzle impinges on the grooves. The plate itself is mounted for rotation about a normally fixed, i.e., non-rotating shaft. Within the rotor plate, there is a chamber adapted to be at least partially filled with a high viscosity fluid. At the same time, there is a fixed stator mounted on the shaft and located within the chamber. As the rotor plate and chamber wall rotate about the shaft and the fixed stator, shearing of the viscous fluid occurs, slowing down the rotation of the rotor plate to produce a uniform and more well defined pattern. The shaft extends out of the rotor plate and into the sprinkler body, through the center of the nozzle. The nozzle itself is a replaceable item, interchangeable with nozzles having various opening configurations. The nozzle and an underlying generally cylindrical core flow path component are sandwiched between a removable sprinkler body cap and a baffle fixed to the lower end of the shaft for rotation with the shaft. The baffle contains a series of spokes or lobes which can rotate relative to ports formed in the core flow path component to regulate the amount of water flowing to the nozzle.

A rotor plate cap, held in place on the rotor plate by a retainer ring, is formed with an annular array of teeth adapted to engage with a mating annular array of teeth formed in the upper surface of the stator within the fluid chamber. The rotor plate cap and rotor plate can be pressed downwardly (assuming an upright orientation for the sprinkler) on the shaft (and relative to the shaft) so as to cause the teeth on the rotor plate cap and the fixed stator to engage. With the teeth so engaged, a "drive" mechanism is established between the rotor plate and the shaft so that manual rotation of the rotor plate causes the shaft to rotate as well. This results in the baffle rotating relative to the core flow path component to thereby throttle the flow through ports in the core to achieve the desired throw radius. When the rotor plate is pulled upwardly to its original position, the respective teeth on the rotor plate cap and stator are disengaged, and the rotor plate is then free to rotate relative to the shaft in a normal operating mode.

Thus, in accordance with its broader aspects, the present invention relates to a rotating stream sprinkler comprising a rotor plate supported on one end of a shaft for rotation, in an operative mode, relative to the shaft; a nozzle located along the shaft upstream of the rotor plate; a baffle fixed to an opposite end of the shaft; a core flow path component located along the shaft between the nozzle and the baffle; and a drive mechanism for enabling in an adjustment mode, rotation of the rotor plate with the shaft and the baffle relative to the core flow path component to thereby alter the flow of water through the core flow path component toward the nozzle.

DETAILED DESCRIPTION OF THE DRAWINGS

Figure 1:
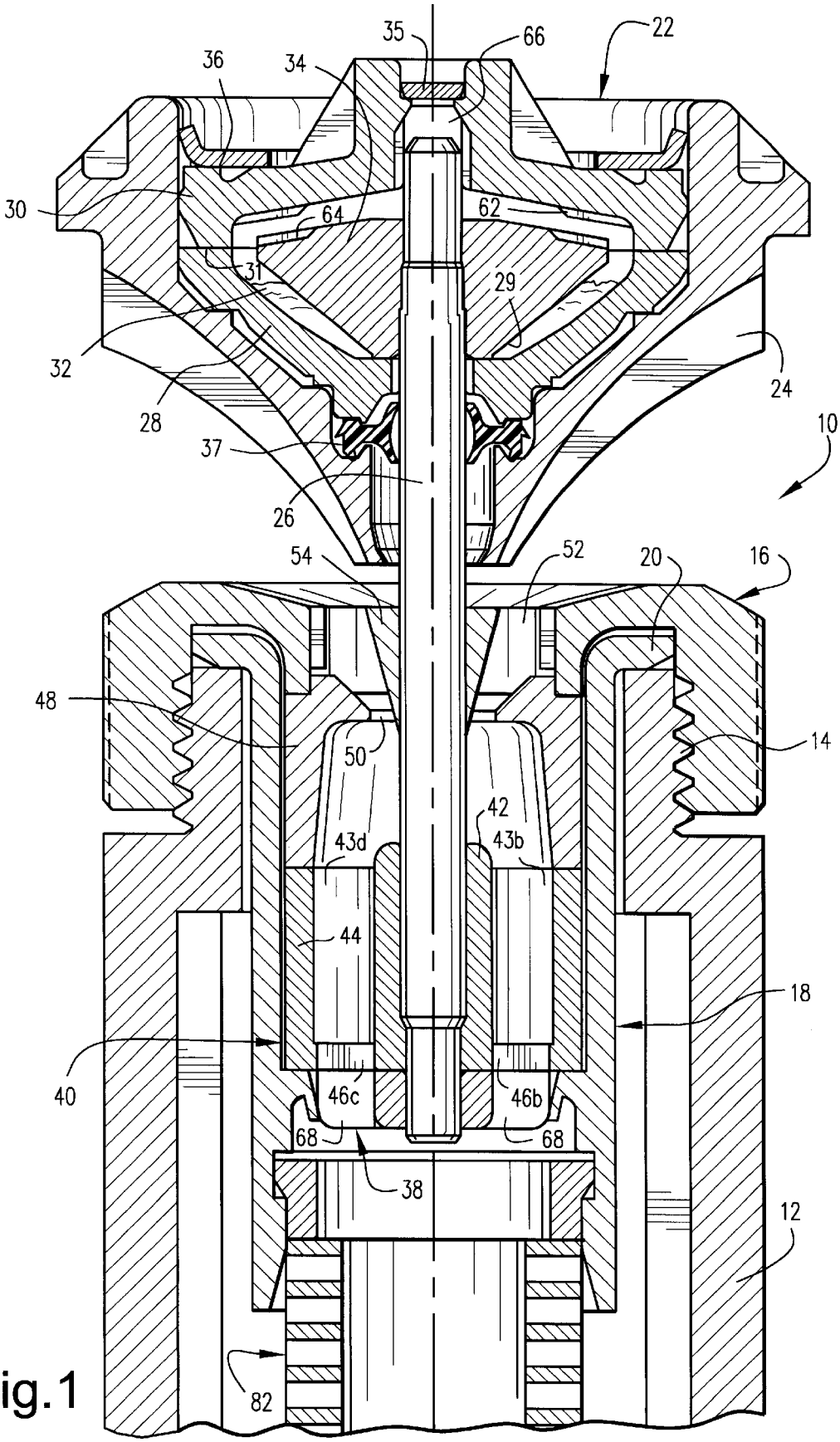
FIG. 1 is a partial side elevation of a micro-stream rotating type sprinkler in accordance with a first embodiment of the invention.

With reference now to FIG. 1, a rotary sprinkler device 10 is shown in connection with a well known pop-up sprinkler (partially shown) which includes a generally cylindrical riser or outer sleeve 12 which moves up and down within a sprinkler body (not shown) in response to water pressure. A pop-up sprinkler of this type is disclosed in the '806 patent, but this invention may be used with other pop-up sprinklers as well. The sleeve or riser 12 has a threaded upper end 14 to which is threadably engaged a sprinkler body cap 16. The sprinkler mechanism in accordance with this invention is supported within the riser 12 by means of an inner sleeve 18 having a radially outwardly directed flange 20 at the upper end thereof. The inner sleeve 18 is supported on the upper edge of the threaded upper end 14 of the outer sleeve or riser 12 and is held in place by the cap 16. The sprinkling mechanism itself includes a rotor plate 22, the underside of which is formed with a plurality of off-center circumferentially arranged grooves 24 which are configured to cause the rotor plate to rotate when a stream emitted from the sprinkler body impinges on the grooves. The rotor plate is supported on a generally stationary shaft 26 for rotation relative to the shaft. Within the rotor plate, there is a dish-shaped bearing 28, the lower end of which is formed with a hole 29 through which the shaft 26 passes. The upper end of the bearing is engaged by a lower edge 31 of an annular rotor body cap 30, these two components defining an internal fluid chamber 32. A fixed stator 34 is press fit onto the shaft 26 and is located within the chamber. The chamber is adapted to be filled or partially filled with a highly viscous fluid in order to slow the rotating or whirling speed of the rotor plate to a degree which maximizes stream uniformity. The rotor plate cap 30 is secured to the rotor plate 22 by means of an annular retainer ring 36. An annular flex seal 37 seals the lower end of the chamber 32 to prevent leakage of fluid as well as to prevent the ingress of dirt or debris into the chamber. The upper end of the chamber 32 is sealed by a plug 35 press fit in the top of the rotor plate cap 30. It is significant that there is a space between the top of the shaft 26 and the plug 35 which permits axial downward movement of the rotor plate 22 on and relative to the shaft 26 as explained further below.

Figure 7:
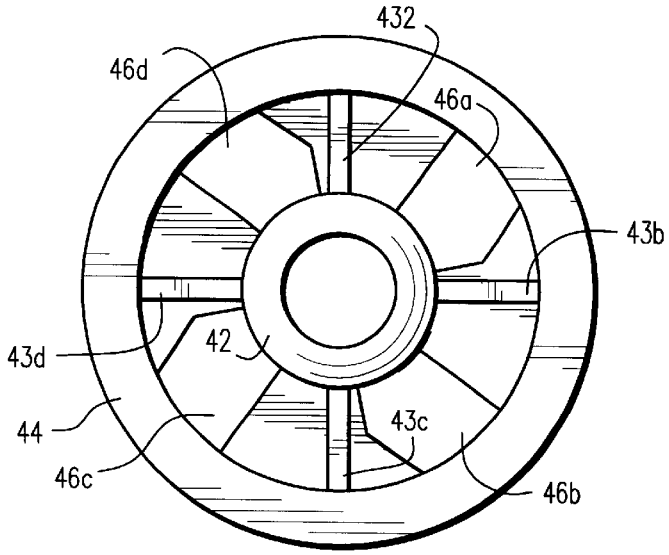
FIG. 7 is a top plan view of the core flow path component incorporated in FIGS. 1 and 2 and shown partially in FIGS. 3–5.

The opposite end of the shaft 26 supports three axially aligned components within the inner sleeve 18 in the sprinkler body. The first of these components is a baffle 38 (see also FIGS. 3–5) fixed to the lower end of the shaft 26. A core flow path component 40 is slidably received on the shaft above the baffle 38, and includes an inner wall 42 and an outer wall 44 with an annular space therebetween. The space is divided into four discrete flow passages by internal ribs 43*a, b, c* and *d*. These passages are accessed by four ports 46*a, b, c* and *d* at the lower end of the core, best seen in FIGS. 1 and 7. The ports 46 are smaller in cross sectional area than the passages themselves.

Supported above the core component is an annular nozzle 48 which has an open lower end axially aligned with the flow passages in the core component. The upper end of the nozzle has a restricted orifice 50 which may extend, e.g., 360°, about the shaft 26; 180° (see especially FIG. 8) about the shaft; or 90° about the shaft, depending on the desired shape of the sprinkling pattern. In the illustrated embodiment, the orifice extends approximately 180°. Note that the sprinkler body cap 16 includes a similarly shaped orifice 52 extending about a conically shaped, annular mounting sleeve 54 through which the shaft 26 passes.

Figure 8:
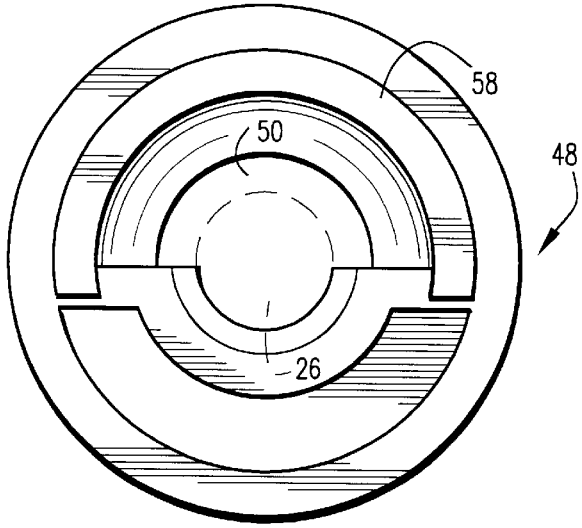
FIG. 8 is a top plan view of the nozzle component incorporated in the sprinkler shown in FIGS. 1, 2 and 6.
Figure 9:
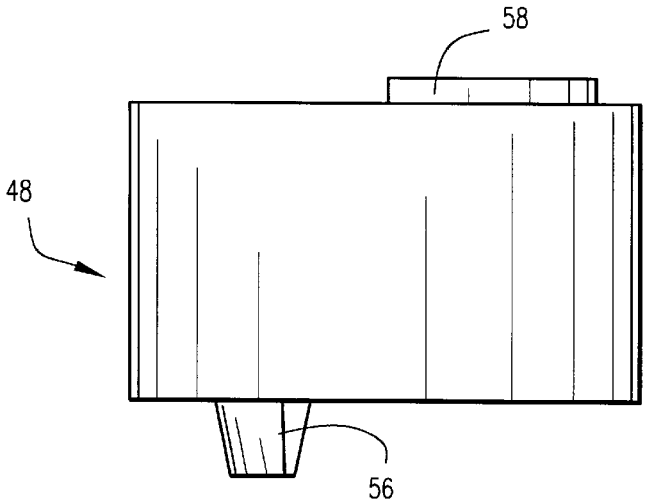
FIG. 9 is a side elevation of the nozzle component shown in FIG. 8 but rotated 90° in a clockwise direction.
Figure 10:
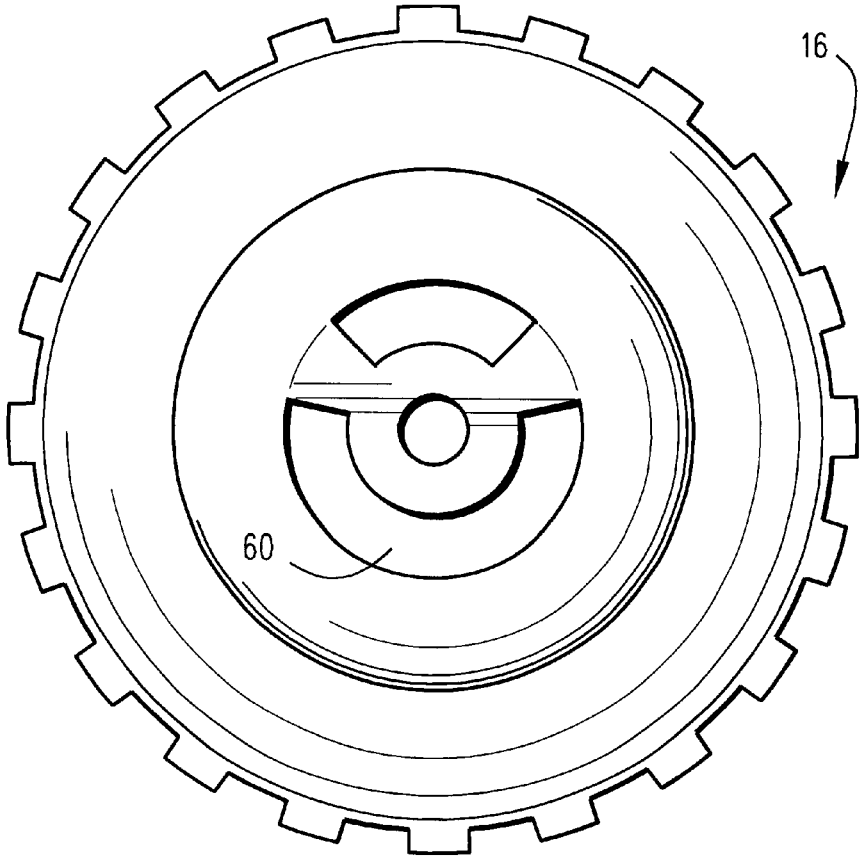
FIG. 10 is a top plan view of the sprinkler body cap incorporated in the sprinkler shown in FIGS. 1, 2 and 6.
Figure 11:
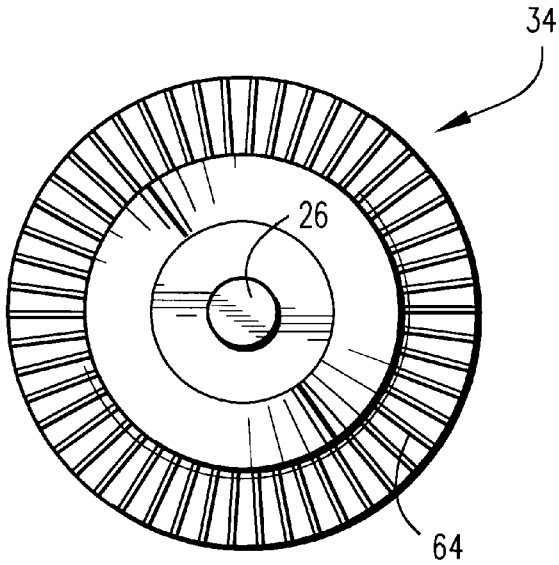
FIG. 11 is a top plan view of the stator component incorporated in the sprinkler shown in FIGS. 1, 2 and 6.
Figure 12:
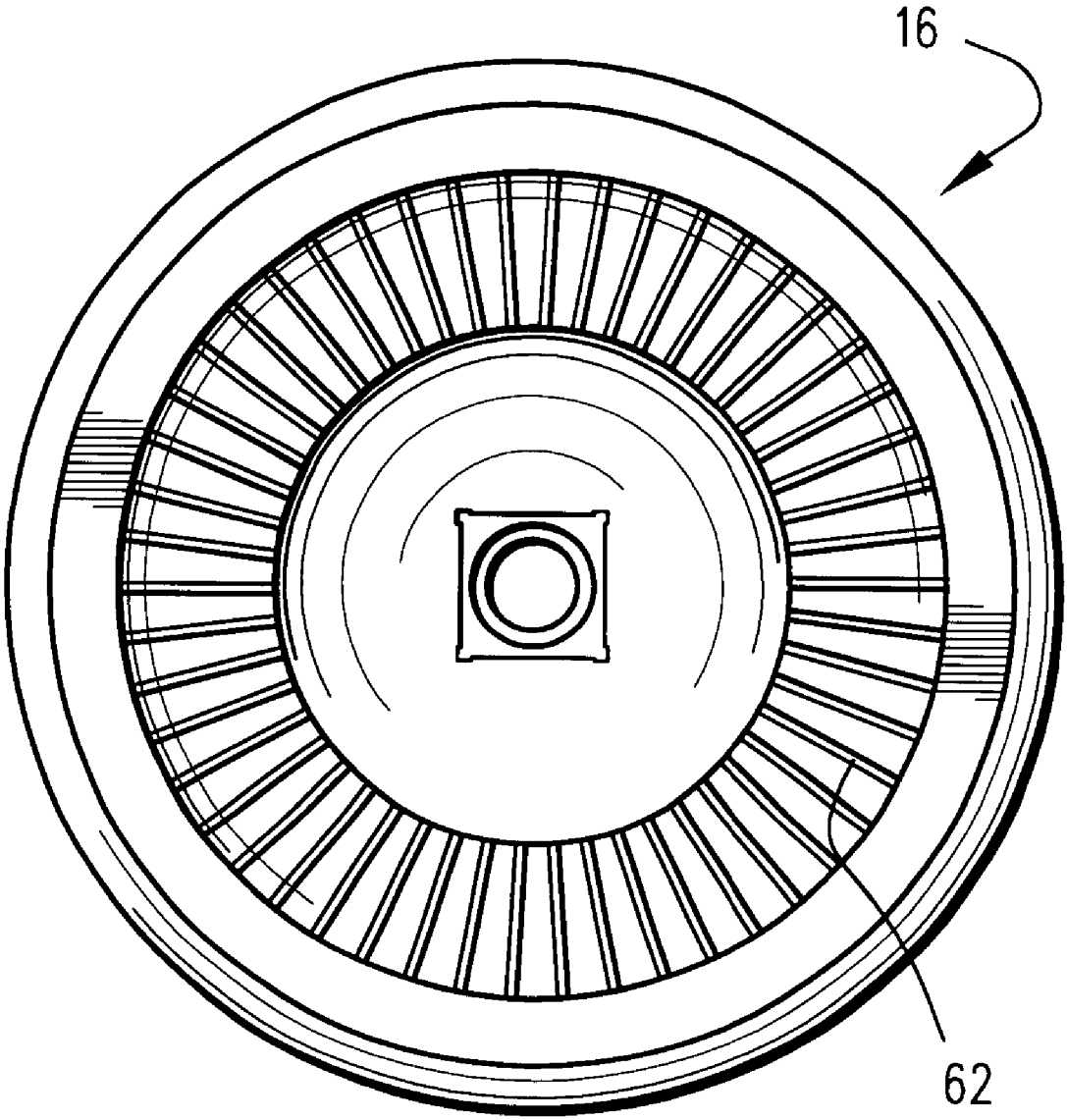
FIG. 12 is a bottom plan view of the rotor plate cap component incorporated in the sprinkler shown in FIGS. 1, 2 and 6.
Figure 1:
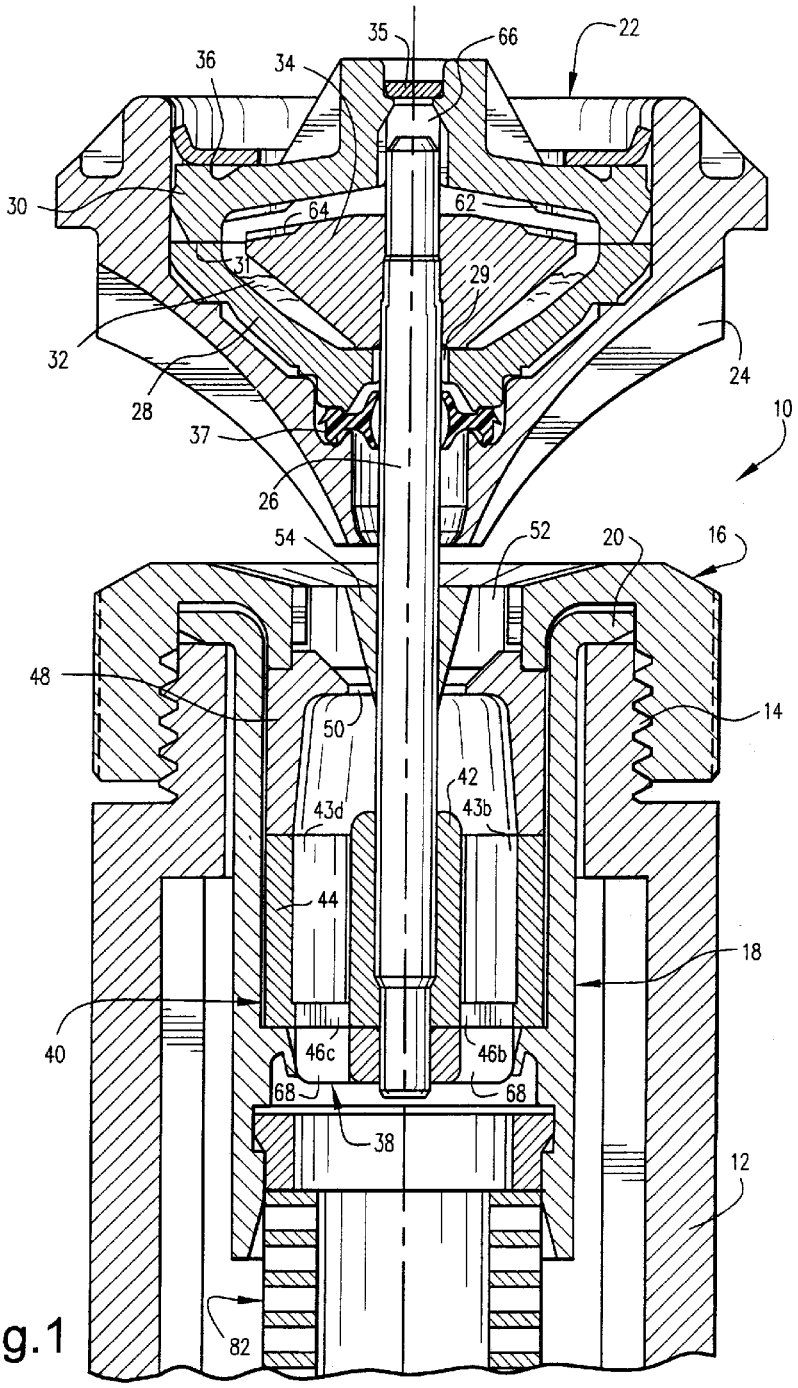
Figure 2:
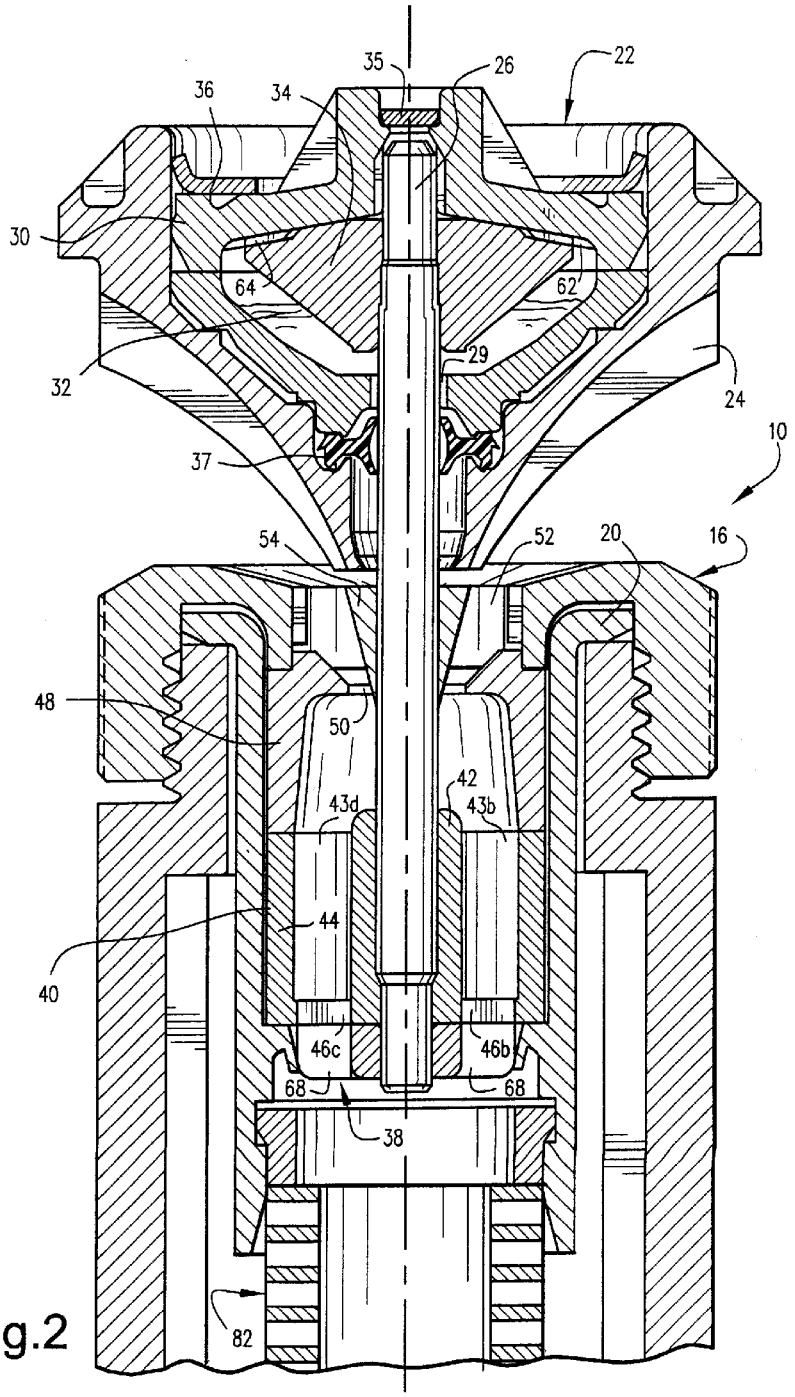

With reference now also to FIGS. 8 and 9, the nozzle component 48 has a depending tab 56 which seats within one of the discrete flow passages in the core flow path component 40. At the same time, the upper end of the nozzle component 48 is provided with a raised arcuate rib 58 extending approximately 180° about the circumference of the nozzle component, that is adapted to seat within the similarly shaped groove 60 on the underside of the sprinkler body cap 16 (see FIG. 10). Since the cap 16 is threadably secured on the riser 12, it will be appreciated that by "keying" the nozzle to both the core flow path component 40 and the sprinkler body cap 16 (via tab 56 and rib 58, respectively), the core flow path component 40 and the nozzle 48 are prevented from any rotation within the sleeve 18. On the other hand, the baffle 38 is rotatable with the shaft 26 relative to the ports 46*a, b, c* and *d* in an adjustment mode as described further below.

Returning to FIG. 1, it may be seen that the underside of the rotor plate cap 30 is provided with an annular array of teeth 62 and the upper surface of the stator 34 is provided with an annular array of mating teeth 64. Since the shaft 26 is sized to allow an axial space 66 between the upper end of the shaft and the plug 35 which prevents escape of any viscous fluid from the upper end of the rotor plate, the rotor plate 22 as well as the rotor body cap 30 and bearing 28 can be pressed downwardly along the shaft 26 relative to the fixed stator 34. This movement is apparent from FIG. 2 which shows the mating teeth 60 and 62 in engagement by reason of a downward pressing action on the rotor plate 22. With the rotor plate and stator so engaged, it will be appreciated that by rotating the rotor plate, the shaft 26 as well as the baffle 38 at the lower end of the shaft will rotate relative to the fixed core component 40.

Figure 3:
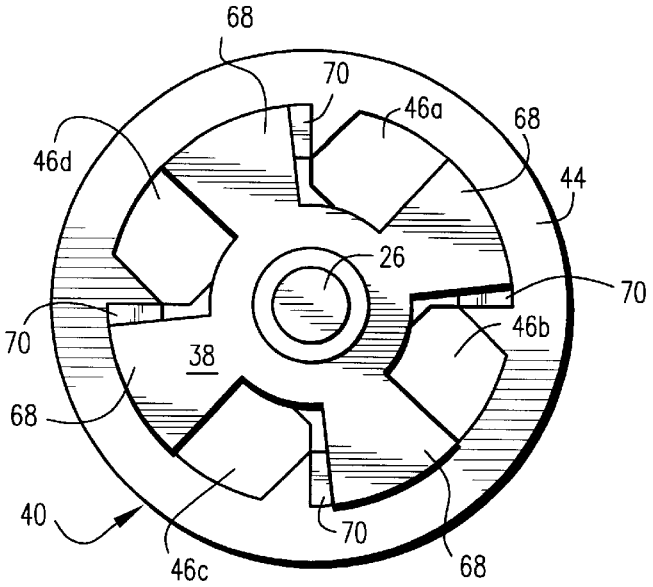
FIG. 3 is a bottom plan view of a baffle and core flow through component, with the ports in the core wide open.
Figure 4:
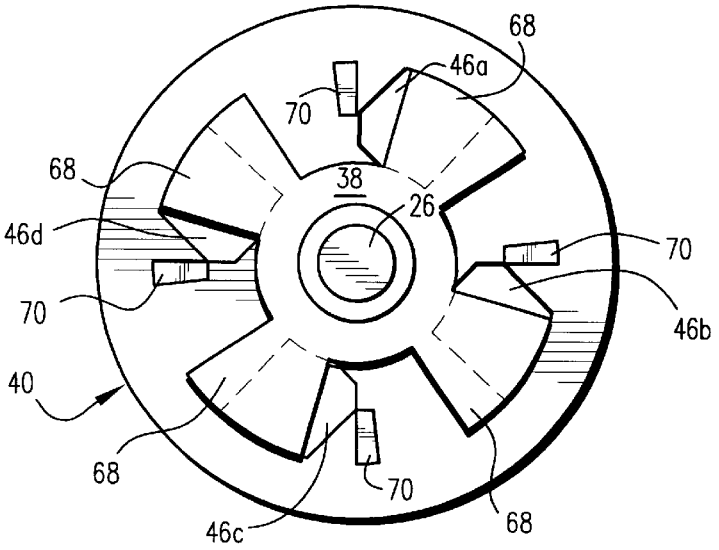
FIG. 4 is a view similar to FIG. 3 but illustrating the baffle rotated to a position that partially closes the ports in the core.
Figure 5:
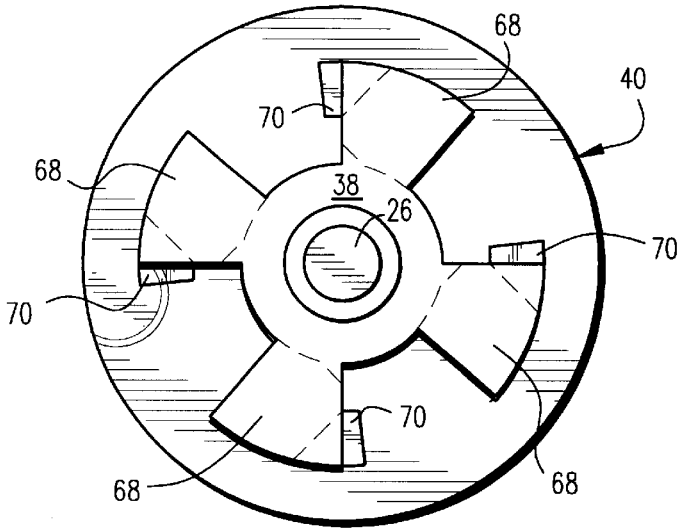
FIG. 5 is a view similar to FIG. 4 but with the baffle rotated to a position that fully closes the ports in the core.

Turning now to FIGS. 3–5, it can be seen that radially extending lobes 68 on the baffle 38 are rotatable between a fully open position as shown in FIG. 3, where the ports 46*a* through *d* in the core flow path component 40 are wide open, and where the lobes 68 have been rotated against one side of stop elements 70 to positions as shown in either FIG. 4 or 5 (or anywhere in between). Thus, in FIG. 4, the baffle 38 has been shown rotated slightly in a counterclockwise direction to partially close the ports 46*a* through *d*. This will reduce the flow rate of water through the apertures and into the nozzle component, thus reducing both the flow rate and the radius of throw of the emitted stream. FIG. 5 illustrates a condition where the baffle 38 has been rotated to the maximum extent possible in a counterclockwise direction, so that the lobes 68 engage the opposite sides of stop elements 70, and, in this position, the ports 46*a* through *d* in the core flow path component 40 are fully closed, thus preventing any flow from reaching the nozzle component. It is not necessarily anticipated that the ports would be fully closed in any normal application, but the drawings nevertheless indicate the full range of movement of the baffle 38.

Returning to FIG. 2, after the flow adjustment described above, the rotor plate 22 is pulled upwardly and returned to the position shown in FIG. 1 such that the mating arrays of teeth 62 and 64 will become disengaged so that rotation of the rotor plate 22 will not cause commensurate rotation of the shaft 26. Thus, when water flows through the nozzle 48 and impinges on the grooves 24, the rotor plate 22 will rotate about the shaft 26 to distribute the water stream radially outwardly in the desired sprinkling pattern, with a reduced (or increased) radius of throw and reduced (or increased) flow rate, depending on the adjustment.

Figure 6:
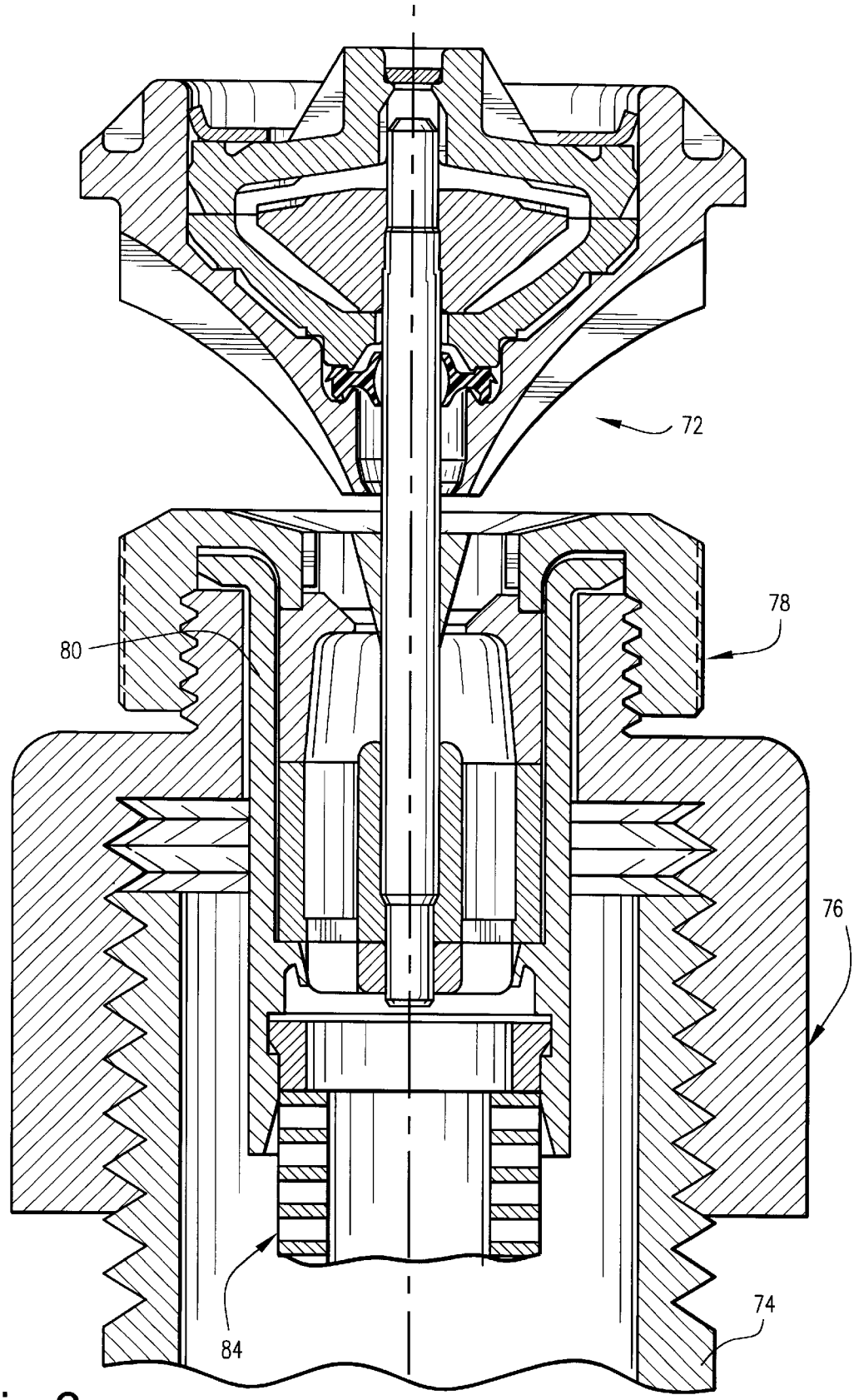
FIG. 6 is a partial side section of a micro-stream rotator in accordance with a second exemplary embodiment of the invention.

In FIG. 6, an alternative sprinkler arrangement is shown where the sprinkler mechanism as described above (indicated generally by numeral 72) is mounted on a fixed riser 74, rather than in a pop-up type sprinkler body. In this embodiment, an adapter 76 is threadably engaged between the fixed riser 74 and a cap 78 similar to sprinkler body cap 16. Note also that flanged sleeve 80 (similar to sleeve 18) is supported on the upper edge of the adapter 76 and sandwiched between the upper edge of the adapter and the cap 78.

In both of the illustrated embodiments, a filter element 82 (or 84) is supported by the respective sleeves 18 and 80, but is not considered part of the invention per se.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rotating stream sprinkler comprising:

a rotor plate supported on one end of a shaft for rotation, in an operative mode, relative to the shaft; a nozzle located along said shaft upstream of said rotor plate; a baffle fixed to an opposite end of the shaft; a core flow path component located along said shaft between said nozzle and said baffle; and a drive mechanism for enabling in an adjustment mode, rotation of said rotor plate with said shaft and said baffle relative to said core flow path component to thereby alter the flow of water through said core flow path component toward said nozzle.

2. The rotating stream sprinkler of claim 1 wherein said core flow path component has a plurality of discrete flow paths defined in part by a plurality of apertures at one end thereof.

3. The rotating stream sprinkler of claim 2 wherein said baffle includes a plurality of radial lobes adapted to engage one end of said core flow path component and to thereby cover or uncover said plurality of apertures when said baffle is rotated relative to said core flow path component.

4. The rotating stream sprinkler of claim 1 wherein said rotor plate is formed with a chamber and said one end of said shaft has a stator fixed thereto within said chamber, said fluid chamber at least partially filled with a viscous fluid.

5. The rotating stream sprinkler of claim 4 wherein said chamber is closed at an upper end thereof by a rotor cap plate.

6. The rotating stream sprinkler of claim 5 wherein an underside of said rotor cap plate is provided with a first plurality of teeth and an upper surface of said stator is provided with a second plurality of mating teeth adapted to engage said first plurality of teeth in said adjustment mode.

7. The rotating stream sprinkler of claim 6 wherein said rotor plate is movable axially on said shaft to enable engagement of said first and second plurality of teeth.

8. A rotating stream sprinkler comprising:

a rotor plate supported on one end of a shaft for rotation, in an operative mode, relative to the shaft; a nozzle located along said shaft upstream of said rotor plate; and means for adapting flow rate to said nozzle upstream of said nozzle without varying water pressure, said means comprising a baffle mounted on an opposite end of said shaft, said baffle including a plurality of radial lobes, a core flow path component located along said shaft between said nozzle and said baffle, said core flow component having an annular array of apertures at one end thereof, wherein said plurality of radial lobes are adapted to engage one end of said core flow path component and to thereby cover or uncover said plurality of apertures when said baffle is rotated relative to said core flow path component.

9. The rotating stream sprinkler of claim 8 wherein said rotor plate is formed with a plurality of grooves in an exterior surface thereof adapted to receive a stream from said nozzle, said grooves configured to cause said rotor plate to rotate when said stream impinges on said grooves.

10. The rotating stream sprinkler of claim 9 wherein said rotor plate has an internal chamber at least partially filled with a viscous fluid, and wherein a stator component is fixed to said shaft and located within said chamber.

11. The rotating stream sprinkler of claim 8 incorporated in a pop-up sprinkler body.

12. The rotating stream sprinkler of claim 8 including an adapter for mounting the rotating stream sprinkler on a fixed riser.

* * * * *

UNITED STATES PATENT AND TRADEMARK OFFICE

CERTIFICATE OF CORRECTION

PATENT NO. : 6,244,521 B1
DATED : June 12, 2001
INVENTOR(S) : Sesser

Figure 2:
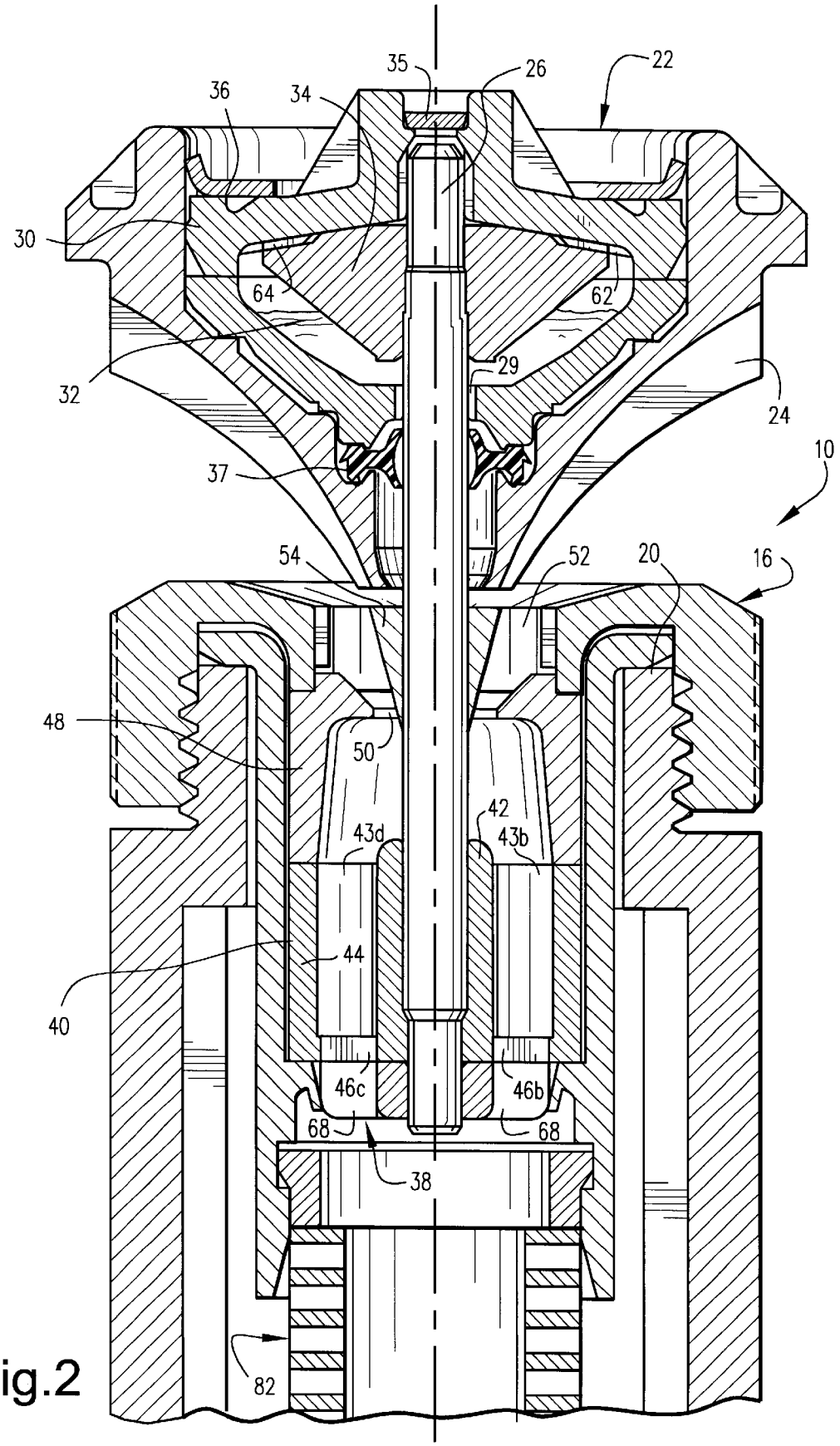
FIG. 2 is a partial side section similar to FIG. 1, but with the rotor plate of the sprinkler pressed downwardly to a position that permits adjustment of the flow rate.

It is certified that error appears in the above-identified patent and that said Letters Patent is hereby corrected as shown below:

Drawings,
The lead line for reference number 29 in Figure 1 has been changed to be consistent with Figure 2, as shown on attached page.

The lead line for reference number 20 in Figure 2 has been changed to be consistent with Figure 1, as shown on attached page.

Signed and Sealed this

Eighth Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,244,521 B1
DATED : June 12, 2001
INVENTOR(S) : Sesser

It is certified that error appears in the above-identified patent and that said Letters Patent is hereby corrected as shown below:

Column 6,
Line 9, delete “adapting” and insert -- adjusting --.

Signed and Sealed this

Third Day of May, 2005

JON W. DUDAS
*Director of the United States Patent and Trademark Office*